US008905014B2

(12) United States Patent
Shaffer

(10) Patent No.: US 8,905,014 B2
(45) Date of Patent: Dec. 9, 2014

(54) OVEN APPLIANCE WITH DUAL POCKETING DOORS

(75) Inventor: Timothy Scott Shaffer, La Grange, KY (US)

(73) Assignee: General Electric Company, Schenectady, NY (US)

( * ) Notice: Subject to any disclaimer, the term of this patent is extended or adjusted under 35 U.S.C. 154(b) by 339 days.

(21) Appl. No.: 13/347,195

(22) Filed: Jan. 10, 2012

(65) Prior Publication Data

US 2013/0174831 A1 Jul. 11, 2013

(51) Int. Cl.
*F24C 15/02* (2006.01)
*F24C 15/26* (2006.01)

(52) U.S. Cl.
USPC ..... 126/190; 219/756; 219/685

(58) Field of Classification Search
CPC ..... F24C 15/02
USPC ..... 219/739; 312/322; 49/40
See application file for complete search history.

(56) References Cited

U.S. PATENT DOCUMENTS

| | | | | |
|---|---|---|---|---|
| 1,874,562 | A * | 8/1932 | Mariotti | 49/40 |
| 2,707,225 | A * | 4/1955 | Pearce | 126/19 R |
| 4,279,454 | A * | 7/1981 | Koiso et al. | 312/297 |
| 4,785,579 | A * | 11/1988 | Sugiyama et al. | 49/40 |
| 4,911,219 | A | 3/1990 | Dalrymple | |
| 5,653,063 | A * | 8/1997 | Barnett et al. | 52/29 |
| 6,032,762 | A * | 3/2000 | O'Donnell et al. | 187/316 |
| 6,073,394 | A * | 6/2000 | Uhl | 49/41 |
| 6,199,548 | B1 * | 3/2001 | Hsu | 126/194 |
| D487,666 | S * | 3/2004 | Monguilod | D7/351 |
| 6,956,191 | B2 * | 10/2005 | Han et al. | 219/685 |
| 7,021,002 | B2 | 4/2006 | Nat | |
| D523,282 | S * | 6/2006 | Yoon | D7/351 |
| D562,586 | S * | 2/2008 | Parker | D6/433 |
| 7,626,348 | B2 * | 12/2009 | Cartier et al. | 318/135 |
| 8,067,705 | B2 * | 11/2011 | Izumo et al. | 177/180 |
| 2003/0146203 | A1 * | 8/2003 | Wang | 219/411 |
| 2009/0294441 | A1 * | 12/2009 | Wen et al. | 219/756 |

FOREIGN PATENT DOCUMENTS

| | | | |
|---|---|---|---|
| CN | 200993426 | Y | 12/2007 |

* cited by examiner

*Primary Examiner* — Steven B. McAllister
*Assistant Examiner* — Rabeeul Zuberi
(74) *Attorney, Agent, or Firm* — Dority & Manning, P.A.

(57) ABSTRACT

An oven appliance with a pair of doors is provided. The doors slide along a track in order to open and close and are coupled with a linkage assembly. The linkage assembly allows movement of one of the doors to be transferred to the other door such that the doors open and close simultaneously. When the doors are open, the doors are stored in pockets defined in the oven appliance.

15 Claims, 6 Drawing Sheets

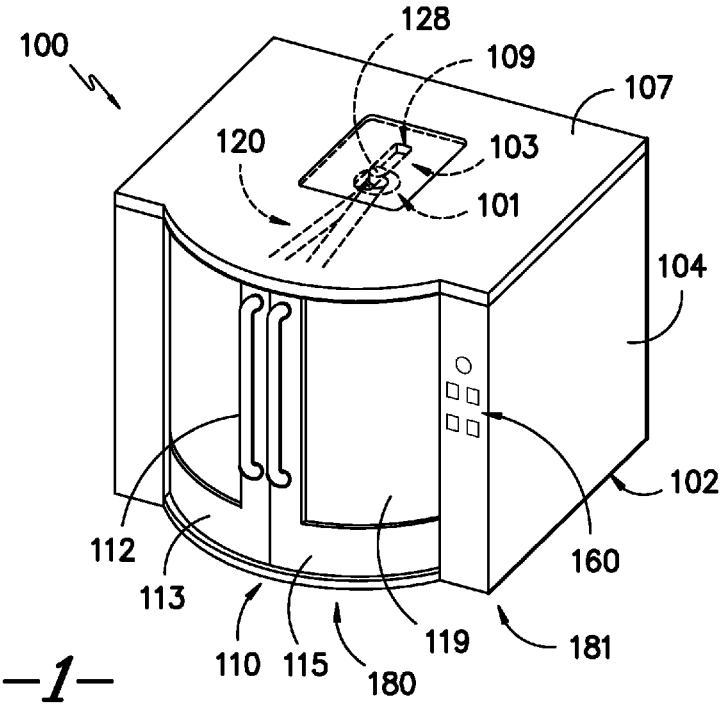
FIG. —1—
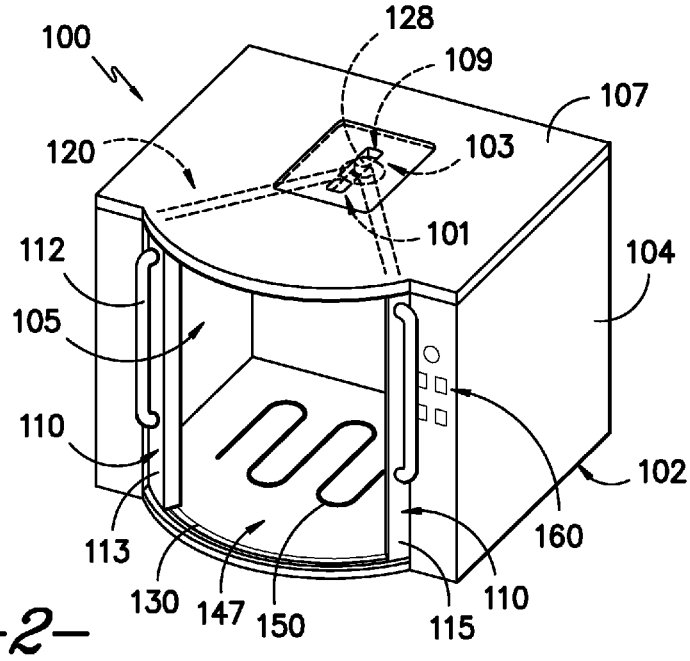
FIG. —2—

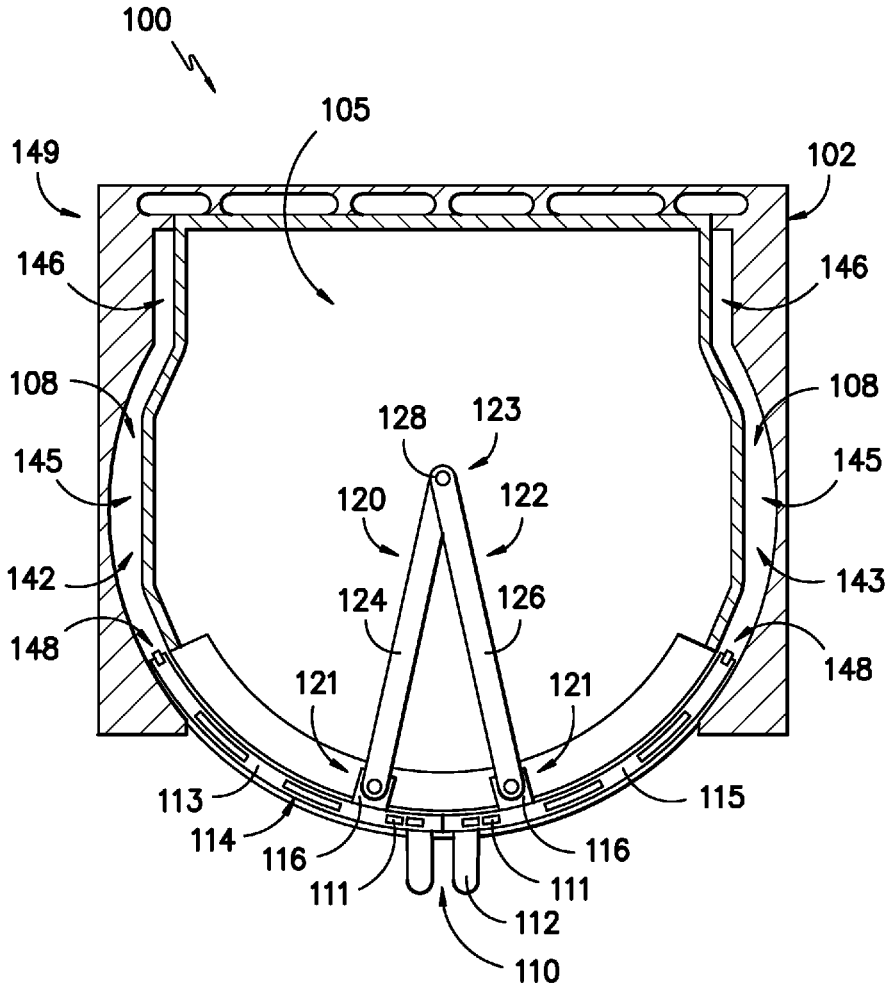
*FIG. –5–*

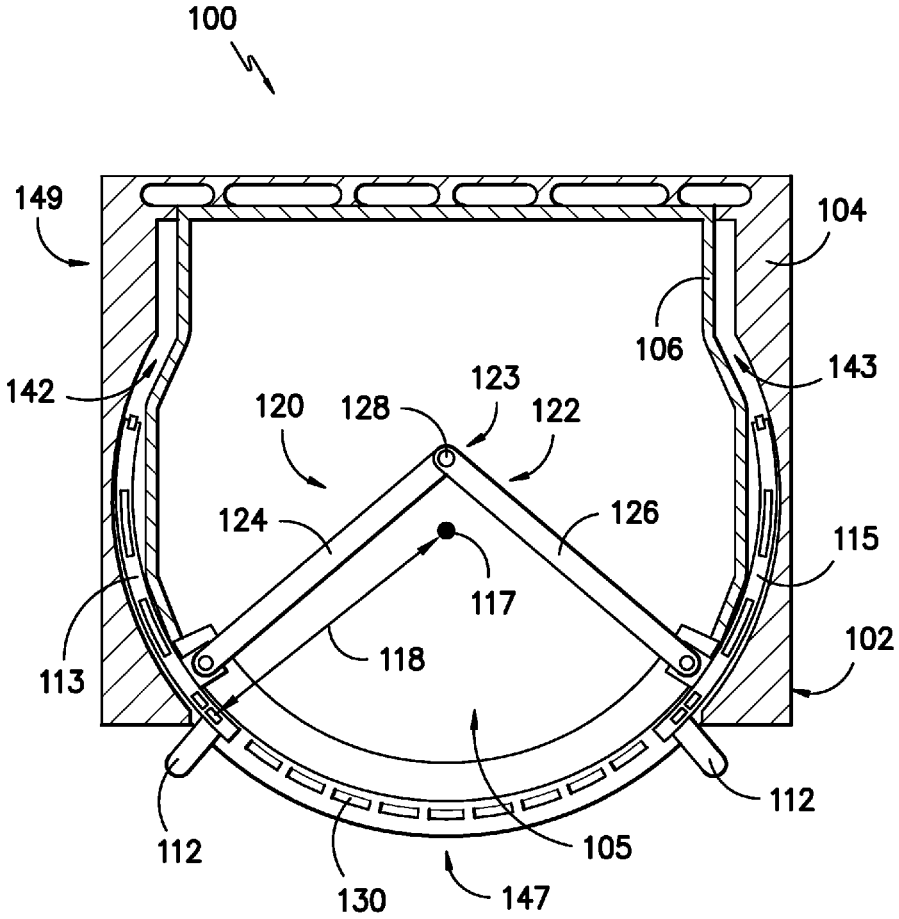
FIG. –6–

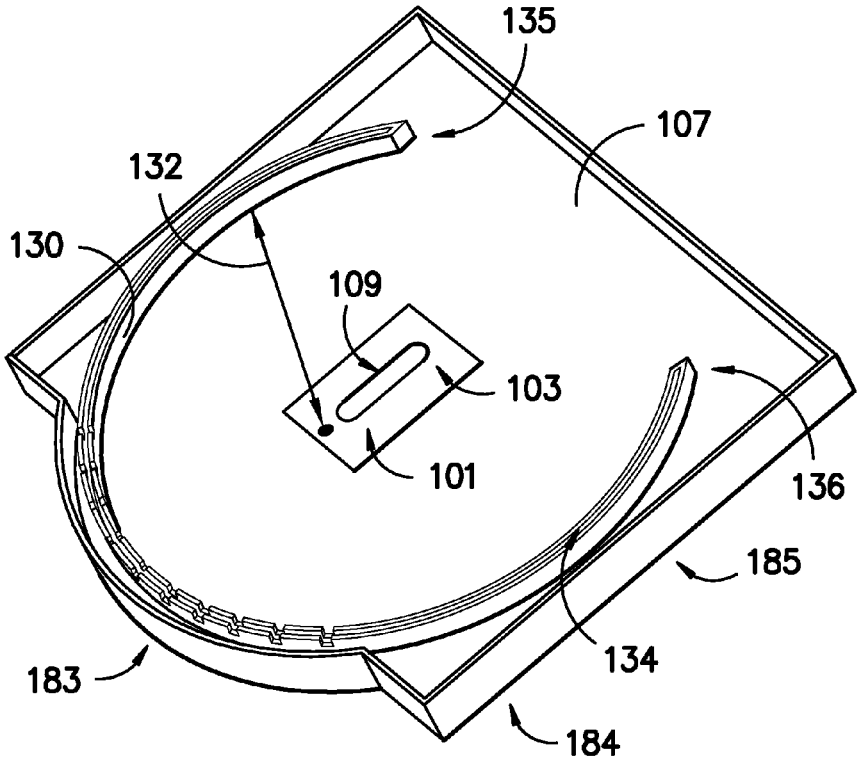
FIG. –7–
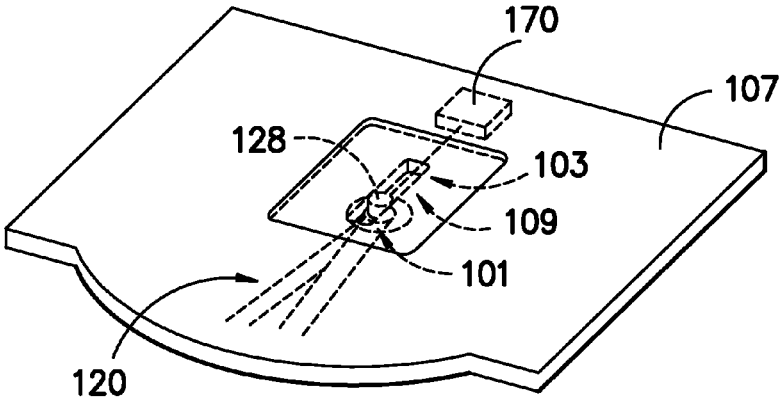
FIG. –8–

OVEN APPLIANCE WITH DUAL POCKETING DOORS

FIELD OF THE INVENTION

The present subject matter relates generally to an oven appliance with dual pocketing doors for accessing one or more cooking chambers of the appliance.

BACKGROUND OF THE INVENTION

Conventional oven appliances generally include a cabinet that defines a chamber where food items are received for the application of heat or other energy to cook the food. Access to the chamber is controlled through one or more doors located on the front of the appliance. The user of the appliance can open or close the door(s) to provide a seal and insulation that helps retain heat energy during cooking.

In certain conventional oven designs, the oven door is rotatably mounted to the oven's cabinet. In such designs, the door has an axis about which the door is rotatable in order to open and close. To open the door, the user pulls a handle on the door, and the door rotates away from the cabinet about the axis of rotation. However, when the user rotates the door away from the cabinet, the door projects into a kitchen's work space. Thus, an area in front of the cabinet must remain free of obstructions in order for the door to open freely. The area required for the door to open freely can be large and consume a significant portion of the kitchen's work space. Because work space is a premium in many kitchens, an oven door that conserves such valuable work space would be appreciated in the art.

In addition, for ovens having double doors (e.g., "French" doors), typically both doors must be opened separately by the user in order to remove large food items from the cooking chamber or to clean the chamber. If the user is already holding an object—such as food or cooking utensil—the opening of each door separately can be inconvenient and cumbersome.

Accordingly, an oven having double French doors that can be opened without projecting or swinging out into the space in front of the oven would be useful. Such an oven where both doors can be opened by manipulation of only one door would be particularly useful. An oven with such doors that can also be equipped with an automatic actuator would also be beneficial.

BRIEF DESCRIPTION OF THE INVENTION

Aspects and advantages of the invention will be set forth in part in the following description, or may be obvious from the description, or may be learned through practice of the invention.

In one exemplary embodiment, an oven appliance is provided. The oven appliance includes a cabinet defining a chamber for the receipt of food for cooking. The chamber is accessed through an opening defined by the cabinet. The cabinet has sidewalls, a top panel, and a bottom panel. The sidewalls extend between the top panel and the bottom panel. The cabinet also defines a first pocket and a second pocket. The first and second pockets are positioned within the sidewalls and extend between the top panel and the bottom panel. The top panel also defines a slot. The oven appliance also includes a track positioned adjacent the top panel or the bottom panel of the cabinet. The track has a first end and a second end. The first and second ends of the track are positioned within a respective one of the first and second pockets such that the track extends between the first and the second pockets. The oven appliance further includes a pair of doors slidingly mounted to the track. The doors are configured for permitting selective access to the chamber of the cabinet. In addition, the oven appliance includes a pair of links. Each of the links has a first end spaced apart longitudinally from a second end. The first ends of the links are rotatably connected to a respective one of the doors. Finally, the oven appliance includes a pin slidably positioned within the slot of the top panel of the cabinet. The second ends of the links are rotatably coupled with the pin.

In a second embodiment, an oven appliance is provided. The oven appliance has a cabinet that defines a chamber for receipt of food for cooking. The chamber is accessed through an opening defined by the cabinet. The cabinet also defines a first pocket and a second pocket. The first and second pockets have an entrance positioned adjacent the opening of the cabinet. The oven appliance also includes a track positioned between the cabinet and the chamber. The track has a first end and a second end. The first and second ends of the track are positioned within a respective one of the first and second pockets such that the track extends between the first and the second pockets. The track has an arcuate shape between the first pocket and the second pocket. In addition, the oven appliance has a pair of arcuate doors slidingly mounted to the track and configured for permitting selective access to the chamber of the cabinet. The oven appliance further includes a pair of links. Each of the links has a first end spaced apart longitudinally from a second end. The first ends of the links are rotatably connected the doors. Finally, the oven appliance has a pin extending through the second ends of the links such that the second ends of the links are rotatably coupled with the pin. The pin is also received into a slot positioned within the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 illustrates a perspective view of an oven appliance according to an exemplary embodiment of the present subject matter and particularly illustrates a pair of doors in a closed configuration;

FIG. 2 illustrates a perspective view of the exemplary oven appliance of FIG. 1 with the pair of doors in an open configuration.

FIG. 5 illustrates a top cross-sectional view of the oven appliance of FIG. 1 particularly illustrating a linkage assembly according to an exemplary embodiment of the present subject matter, the linkage assembly being in a closed configuration.

FIG. 6 illustrates a top cross-sectional view of the oven appliance of FIG. 5 and particularly illustrates the linkage assembly being in an open configuration.

FIG. 7 is a perspective view of a top cover according to an exemplary embodiment of the present subject matter and particularly illustrates a track.

FIG. 8 is a perspective view of the exemplary top cover of the FIG. 5 and particularly illustrates a linear actuator coupled to a pin of the linkage assembly.

DETAILED DESCRIPTION OF THE INVENTION

Figure 3:
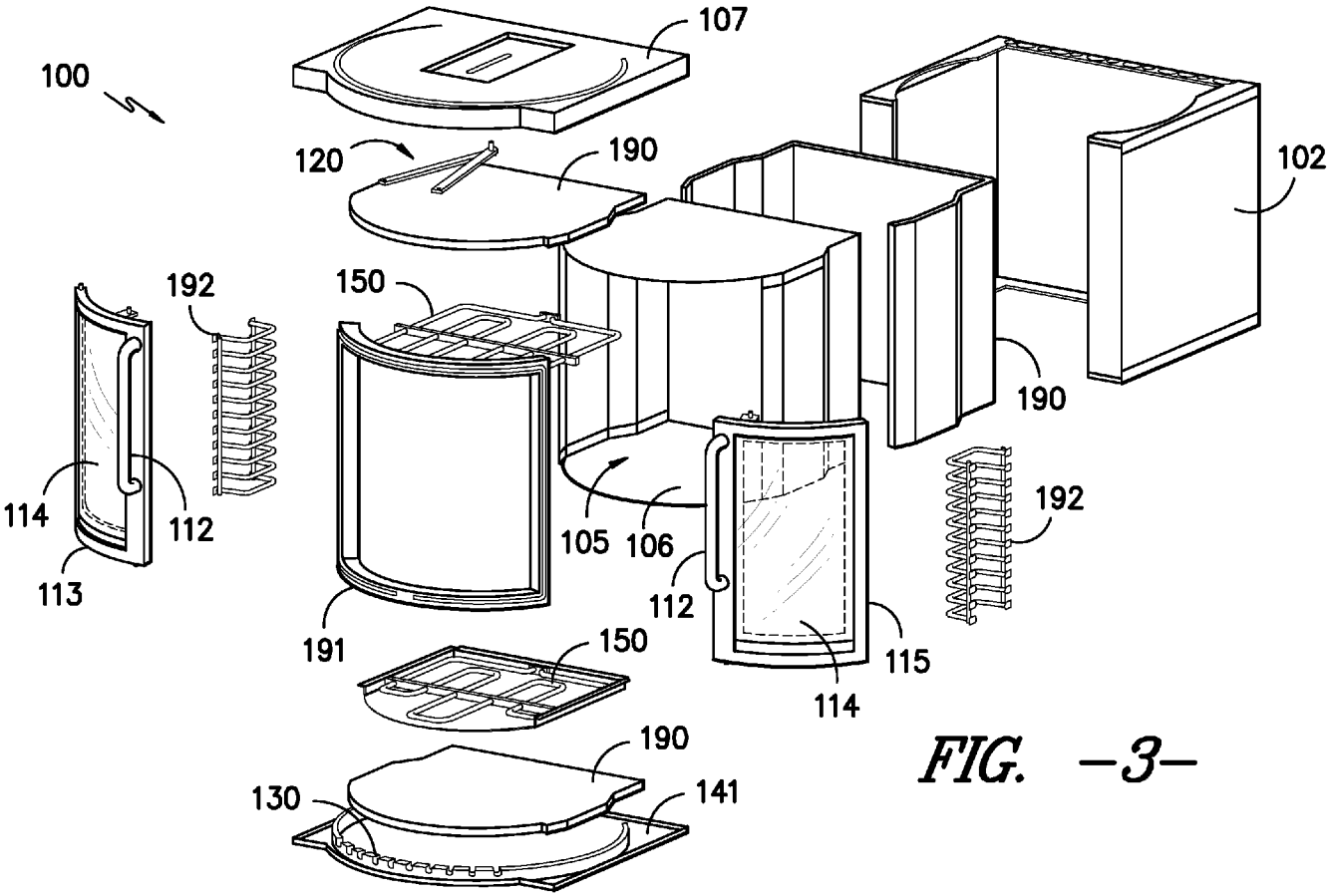
FIG. 3 illustrates an exploded view of the exemplary oven appliance of FIG. 1.

An oven appliance with a pair of doors is provided. The doors slide along a track in order to open and close and are coupled with a linkage assembly. The linkage assembly allows movement of one of the doors to be transferred to the other door such that the doors open and close simultaneously. When the doors are open, the doors are stored in pockets defined in the oven appliance. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIGS. 1 and 2 illustrate perspective views of an oven appliance 100 according to an exemplary embodiment of the present subject matter. The oven 100 includes a cabinet 102 having sidewalls 104 that are spaced apart and substantially cofacing (e.g., substantially parallel). An inner cooking chamber 105 is configured for the receipt of one or more food items to be cooked. The chamber 105 is accessed through an opening 147 defined by the cabinet 102. The oven 100 also includes a pair of doors 110, sometimes referred to as "French doors," mounted to the cabinet 102 and adjacent to the opening 147. The doors 110 slide along a guide or track 130 in order to permit selective access to the chamber 105. The cabinet 102 has an arcuate projection 180 positioned adjacent the doors 110 at a front 181 of the cabinet 102.

The pair of doors 110 has a first door 113 and a second door 115 that are coupled by a linkage assembly 120 such that motion of the first or second door 113,115 is transferred to the other door 113 or 115 respectively so that the doors 110 slide between an open and a closed configurations simultaneously. Each door 110 includes a handle 112 that may be pulled by a user in order to adjust the doors 110 between the open and closed configurations using the linkage assembly 120.

FIG. 1 illustrates the oven appliance 100 in the closed configuration. In the closed configuration, the doors 110 are adjacent such that the doors 110 limit access to the cooking chamber 105 of the oven 100. One or more seals 191 (shown in FIG. 3) between the doors 110 and the cabinet 102 provide for maintaining heat and cooking fumes within chamber 105 when the doors 110 are in the closed configuration. Glass panes 119 provide for viewing the contents of the chamber 105 when the doors 110 are in the closed configuration as well as providing insulation between chamber 105 and an exterior of the oven 100.

FIG. 2 illustrates the oven appliance 100 of FIG. 1 in the open configuration. In the open configuration, the cooking chamber 105 may be accessed because the doors 110 are not adjacent. A heating element 150 is positioned within the chamber 105 of the cabinet 102. The heating element 150 is used to heat the chamber 105 for both cooking and cleaning of the oven 100. While an electrically-resistive heating element 150 is shown, the present subject matter may be used with other heating elements as well such as gas burners, microwave elements, or combinations thereof. Rack supports 192 (shown in FIGS. 3 and 4) may be positioned in chamber 105 for the receipt of food items. Racks (not shown) may be slidably mounted so that the racks may be conveniently moved into and out of the chamber 105 when the doors 110 are open.

Operation of the oven 100 including the heating element 150 is controlled by one or more processing devices (not shown) such as a microprocessor other device that is in communication with such components. User manipulated controls 160 allow the user to make selections regarding temperature, time, and other options. The selections can be communicated to the processing device for operation of the oven 100.

The oven 100 of FIGS. 1 and 2 is provided by way of example only. The present subject matter may be used with other oven configurations. For example, the present subject matter may be used with an oven defining multiple interior cavities for the receipt of food and/or having different arrangements than what is shown in FIGS. 1 and 2. Also, in FIGS. 1 and 2, the cabinet 102 has a substantially rectangular shape. However, in alternative embodiments, the cabinet 102 may have any other suitable shape, e.g., a substantially square or circular shape. Further, heating elements at the top, back, or sides of chamber 105 may also be provided.

Figure 4:
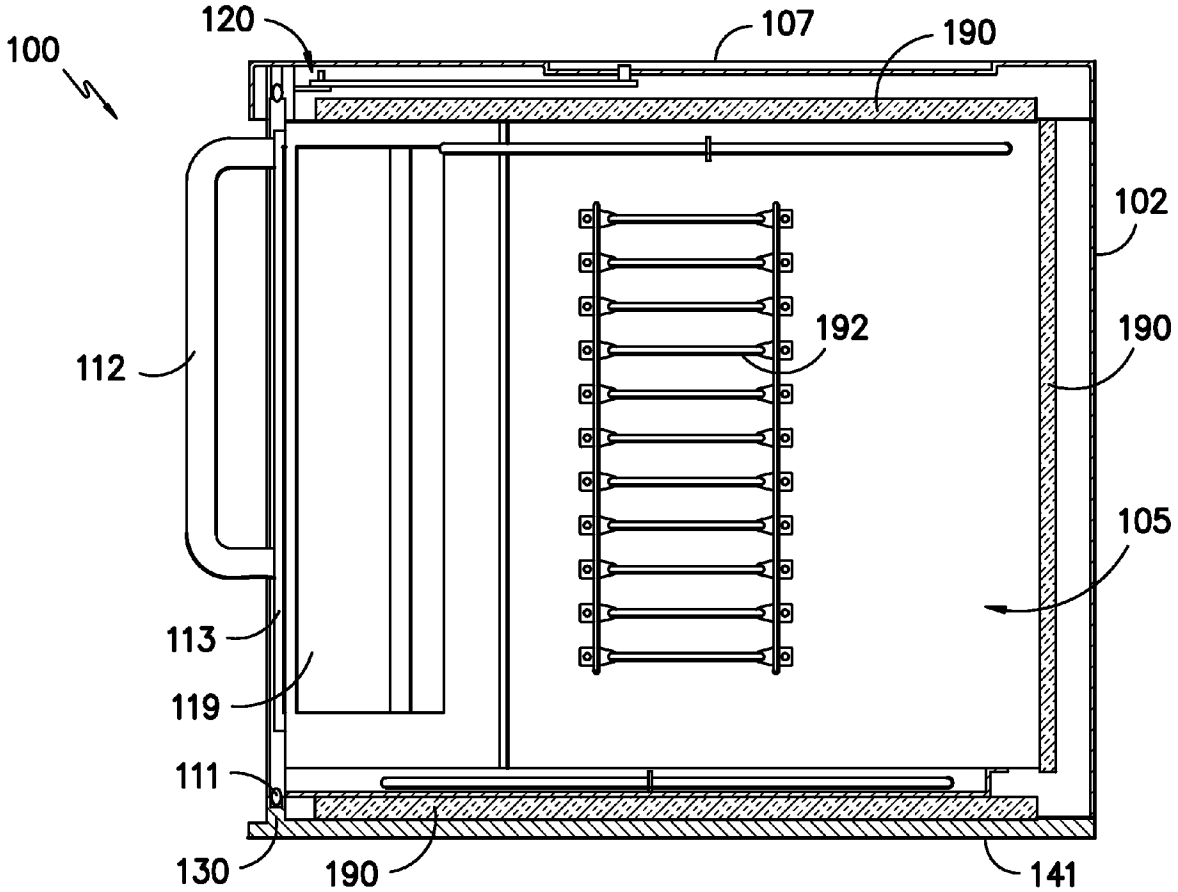
FIG. 4 illustrates a side cross-sectional view of the oven appliance of FIG. 1.

FIG. 3 illustrates an exploded view of the oven 100 of FIG. 1, and FIG. 4 illustrates a side cross-sectional view of the oven 100 of FIG. 1. As may be seen in FIGS. 3 and 4, the oven 100 includes a liner 106 that may be received into the cabinet 102. Liner 106 defines cooking chamber 105. Insulation 190 is disposed between the cabinet 102 and the liner 106 in order to conserve heat within the chamber 105. Similarly, insulation 190 is also disposed between the liner 190 and a top panel 107 and a bottom panel 141 of the oven 100. Thus, the oven 100 has insulation between the liner 106 and the cabinet 102, the top panel 107, and the bottom panel 141. The bottom panel 141 and the top panel 107 are spaced apart and are substantially cofacing (e.g., the bottom panel 141 and top panel 107 may be substantially parallel). The sidewalls 104 of the cabinet 102 extend between the top panel 107 and the bottom panel 141.

FIGS. 5 and 6 illustrate top cross-sectional views of the exemplary oven appliance 100 embodiment of FIGS. 1 and 2 respectively. FIGS. 5 and 6 particularly illustrate the linkage assembly 120 with the doors 110 in an open and closed configuration respectively. The linkage assembly 120 includes a pair of links 122 with a first link 124 and a second link 126. Each of the links 124,126 extend between a first end 121 and a second end 123. Thus, the first ends 124 of the links 122 are spaced apart longitudinally from the second ends 126 of the links 122.

The first ends 121 of the links 122 are rotatably connected to a bracket 116 on a respective one of the doors 110. Thus, the first ends 121 of the links are rotatably coupled to a respective one of the doors 122. The second ends 123 of the links 122 are positioned within the chamber 105 of the cabinet 102 and are rotatably coupled using a pin 128. The pin 128 extends through the second ends 123 of the links 122.

As discussed above, the linkage assembly 120 is configured such that movement of either of the pair of doors 110 is shifted to the other door. For example, if a user pulls the handle 112 on the first door 113 in the closed configuration shown in FIG. 5, the bracket 116 on the first door 113 will transfer the motion of the first door 113 to the first link 124. In turn, the pin 128 will transfer the motion of the first link 124 to the second link 126, and the second link 126 will transfer the motion to the bracket 116 of the second door 115. In such a manner, the motion of the first door 113 is transferred through the linkage assembly 120 to the second door 115, and the second door 115 slides into the open configuration shown in FIG. 6 simultaneously with the first door 113.

As the linkage assembly 120 simultaneously slides the doors 110 from the closed configuration of FIG. 5 to the open configuration of FIG. 6, the doors 110 enter pockets 108 defined between the cabinet 102 and an oven liner 106. In order for the doors 110 to slide into the pockets 108, the pockets 108 extend between the top panel 107 (shown in FIGS. 1 and 2) and the bottom panel 141. The pockets 108 have entrances 148 positioned adjacent the opening 147 that receive the doors 110 as the doors 110 enter the pockets 108. The pockets 108 also have an arcuate portion 145 and a linear portion 146 that extend between the top panel 107 (shown in FIGS. 1 and 2) and the bottom panel 141. The arcuate portion 145 is positioned adjacent the entrance 148 of the pockets 108 and the doors 120. The linear portion 146 is positioned adjacent the sidewalls 104 at a back 149 of the cabinet 102.

As shown in FIG. 6, the doors 120 slide into the pockets 108 along the track 130 as the doors 110 shift from the closed configuration to the open configuration. For example, the first door 113 may slide into a first pocket 142 and the second door 115 may slide into a second pocket 143. It should be understood that, in alternative embodiments, the pockets 108 may be defined by the cabinet 102 (e.g., the sidewalls 104 of the cabinet 102), the oven liner 106, or any other suitable component of the oven appliance 100.

To assist the doors 120 in sliding between the open and closed configurations, the doors 110 include casters 111 mounted to an edge of the doors 110. The casters 111 roll within the track 130 to guide the doors between the open and closed configurations. In various embodiments, the casters 111 may be wheels, rollers, or any other device suitable for sliding or rolling the door between the open and closed configurations.

In FIGS. 5 and 6, the doors 110 have an arcuate profile with a radius 118. In alternative embodiments, the doors 110 may define any suitable profile (e.g., a linear profile). The radius 118 of the doors 110 extends from a center 117 of the arcuate shape to an outer surface 114 of the doors 110.

In addition, as shown in FIG. 5, the first and second links 124,126 define an acute angle in the closed configuration. In various embodiments, the acute angle may be about 5°, 10°, 15°, 20°, 30° or any other suitable angle. As shown in FIG. 6, the first and second links 124,126 define an obtuse angle in the open configuration. In various embodiments, the obtuse angle may be about 95°, 100°, 110°, 120°, 130° or any other suitable angle.

As will be understood by those skilled in the art, the dimensions of the links 122, the length of travel by the doors 110, and other factors will affect the angle defined by the first and second links 124,126 in the open and closed configurations. For example, in FIGS. 5 and 6, the pin 128 is not disposed at the center 117 of the doors 110 when the doors 110 are in the open or closed configurations because the links 120 are longer than the radius 118 of the doors 110. However, in alternative embodiments, the links 120 may be shorter than or equal to the radius 118 of the doors. In addition, in FIGS. 5 and 6, the links 122 are also substantially identical (e.g., the links have an identical length). However, in alternative embodiments, the links 122 may not be substantially identical and thus may have different lengths. Accordingly, in alternative embodiments, the angle defined by the first and second links 124,126 in the closed configuration may be a right angle or an obtuse angle, and the angle defined by the first and second links 124,126 in the open configuration may be a right angle or an acute angle.

Referring back to FIGS. 1 and 2, when the doors 110 shift between the open and closed configurations, the pin 128 of the linkage system 120 displaces linearly. Displacement of the pin 128 may be guided by a slot 109 defined in the cabinet 102 such that the pin 128 displaces linearly as the doors 110 slide between the open and closed configurations as described above. Thus, in the closed configuration shown in FIG. 1, the pin 128 is adjacent a first end 101 of a slot 109. While, in the open configuration shown in FIG. 2, the pin is adjacent a second end 103 of the slot 109.

FIG. 7 is a perspective view of the top panel 107 of the oven appliance 100 of FIG. 1. The top panel 107 defines the slot 109 that guides the pin 128 of the linkage assembly 120 (shown in FIGS. 1 and 2) in the manner described above. The top panel 107 also has an arcuate ledge 183 and a substantially rectangular portion 185. The arcuate ledge 183 of the top panel 107 is positioned adjacent the doors 110 (shown in FIGS. 1 and 2) at a front 184 of the top panel 107. The rectangular portion 185 of the top panel 107 is positioned adjacent the sidewalls 104 of the cabinet 102 (shown in FIGS. 1 and 2).

The track 130 is disposed adjacent the top panel 107 in order to guide the doors 110 (shown in FIGS. 1 and 2) as the doors 110 slide between the open and closed configurations. However, in alternative embodiments, the track or an additional track (not shown) may be disposed on the bottom panel 141 (shown in FIG. 2) of the oven appliance 100. The additional track may be substantially identical to the track 130 and may be configured to assist the track 30 in guiding the doors 110.

The track 130 has an arcuate shape. Thus, the arcuate ledge 183 of the top panel 107 is configured for receipt of the arcuately shaped track 130. In addition, the track 130 defines a channel 134 configured for receiving a portion of the doors 110 or the casters 111 of the doors 110 (shown in FIGS. 5 and 6). The track 130 extends between a first end 135 and a second end 136. The track 130 also extends into the pockets 108 of the chamber 105 (shown in FIGS. 5 and 6). Thus, the first end 135 of the track 130 is disposed within the first pocket 142 (shown in FIGS. 5 and 6), and the second end 136 of the track 130 is disposed within the second pocket 143 (shown in FIGS. 5 and 6). Also, the track 130 has a radius 132 such that the radius 132 of the track 130 matches the radius 118 of the doors 110 (shown in FIGS. 5 and 6).

FIG. 8 illustrates a perspective view of the exemplary top panel 107 of the FIG. 5. A linear actuator 170 is coupled to the pin 128 of the linkage assembly 120. The linear actuator 170 is configured for selectively adjusting the doors 110 (shown in FIGS. 1 and 2) between the open and closed configuration. Thus in some embodiments, the handles 112 (shown in FIGS. 1 and 2) of the doors 110 may be unnecessary because rather than manually adjusting the doors with the handles 112, the linear actuator 170 automates adjusting the doors between the open and closed configurations. For example, the linear actuator 170 may adjust the doors 110 (shown in FIGS. 1 and 2) from the closed configuration to the open configuration by linearly displacing the pin 128 from a closed position adjacent the first end 101 of a slot 109 to an open position adjacent the second end 103 of the slot 109. However, in other embodiments, the linear actuator 170 and handles 112 may both be provided in order to selectively operate the doors manually with the handles 112 or automatically with the linear actuator 170. As will be understood by one having skill in the art, the linear actuator 170 may be any suitable mechanical, hydraulic, pneumatic, or electro-mechanical actuator. For example, the linear actuator may be a screw jack, a cam actuator, a hydraulic or pneumatic piston, or any other suitable mechanism capable of displacing the pin 128 linearly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet defining a chamber for receipt of food for cooking, the chamber accessed through an opening defined by said cabinet, said cabinet having sidewalls, a top panel, and a bottom panel, the sidewalls extending between the top panel and the bottom panel, the cabinet also defining a first pocket and a second pocket, the first and second pockets positioned within the sidewalls and extending between the top panel and the bottom panel, the first and second pockets of said cabinet include an arcuate portion extending between the top panel and the bottom panel and a linear portion extending between the top panel and the bottom panel, the top panel also defining a slot;

an arcuate track positioned adjacent the top panel or the bottom panel of said cabinet, the track having a first end and a second end, the first and second ends of said track being positioned within a respective one of the first and second pockets such that the track extends between the first and the second pockets;

a pair of arcuate doors slidingly mounted to said track, said doors configured for sliding along an arcuate path defined by said track and permitting selective access to the chamber of said cabinet;

a pair of links, each of said links having a first end spaced apart longitudinally from a second end, the first ends of said links positioned at and rotatably connected to a respective one of said doors; and a pin slidably positioned within the slot of the top panel of said cabinet, wherein the second ends of said links are rotatably coupled with said pin such that said doors move in a synchronized manner.

2. The oven appliance of claim 1, wherein said doors are at least partially disposed in a respective one of the first and second pockets when said doors are in an open configuration.

3. The oven appliance of claim 1, wherein each of the doors includes a pair of casters mounted to an edge of said doors, and a portion of said casters is positioned within said track.

4. The oven appliance of claim 1, wherein each of said doors has a bracket mounted to a corner of said doors, the first end of said links being rotatably coupled to a respective one of the brackets.

5. The oven appliance of claim 1, wherein said pin is coupled to a linear actuator.

6. The oven appliance of claim 1, wherein said pin is configured to displace linearly along said slot as said doors shift between an open and a closed configuration.

7. The oven appliance of claim 6, wherein said pin is coupled to a linear actuator.

8. The oven appliance of claim 1, wherein the top panel of said cabinet includes an arcuate ledge positioned adjacent said doors and a substantially rectangular portion positioned adjacent the sidewalls of said cabinet.

9. The oven appliance of claim 1, further comprising an additional track, said additional track and said track being disposed on a respective one of the top panel or the bottom panel of said cabinet, said additional track having a first end and a second end, the first and second ends of said additional track being positioned within a respective one of the first and second pockets such that the additional track extends between the first and the second pockets.

10. An oven appliance comprising:

a cabinet defining a chamber for receipt of food for cooking, the chamber accessed through an opening defined by said cabinet, said cabinet also defining a first pocket and a second pocket, the first and second pockets having an entrance positioned adjacent the opening of said cabinet, the first and second pockets of said cabinet include an arcuate portion positioned adjacent the entrance of the pockets and a linear portion positioned adjacent a back of the cabinet;

an arcuate track positioned between said cabinet and the chamber of said cabinet, the track having a first end and a second end, the first and second ends of said track being positioned within a respective one of the first and second pockets such that the track extends between the first and the second pockets, the track having an arcuate shape between the first pocket and the second pocket;

a pair of arcuate doors slidingly mounted to said track and configured for sliding along an arcuate path defined by said track and permitting selective access to the chamber of said cabinet;

a pair of links, each of said links having a first end spaced apart longitudinally from a second end, the first ends of said links positioned at and rotatably connected to said doors; and a pin extending through the second ends of said links such that the second ends of said links are rotatably coupled with said pin such that said doors move in a synchronized manner wherein said pin is received into a slot positioned within said cabinet.

11. The oven appliance of claim 10, wherein each of the doors includes a pair of casters mounted to an edge of said doors, and a portion of said casters are positioned within said track.

12. The oven appliance of claim 10, wherein each of said doors has a bracket mounted to a corner of said doors, the first end of said links being rotatably coupled to a respective one of the brackets.

13. The oven appliance of claim 10, wherein the pin of said links is coupled to a linear actuator.

14. The oven appliance of claim 10, wherein said cabinet includes an arcuate projection positioned adjacent said doors.

15. The oven appliance of claim 10, further comprising an additional track positioned between said cabinet and the chamber of said cabinet, said additional track having a first end and a second end, the first and second ends of said additional track being positioned within a respective one of the first and second pockets such that the additional track extends between the first and the second pockets, said additional track cooperating with said track to slidingly mount said doors.

* * * * *